US010316523B2

(12) United States Patent
Yu

(10) Patent No.: US 10,316,523 B2
(45) Date of Patent: Jun. 11, 2019

(54) BALUSTER JOINT BLOCK

(71) Applicant: LILUN PLASTICS ENTERPRISE CO., LTD, Changhua County (TW)

(72) Inventor: Ching-Chih Yu, Changhua County (TW)

(73) Assignee: LILUN PLASTICS ENTERPRISE CO., LTD., Changhua County (TW)

( * ) Notice: Subject to any disclaimer, the term of this patent is extended or adjusted under 35 U.S.C. 154(b) by 245 days.

(21) Appl. No.: 15/488,457

(22) Filed: Apr. 15, 2017

(65) Prior Publication Data

US 2018/0298616 A1 Oct. 18, 2018

(51) Int. Cl.
*E04F 11/18* (2006.01)

(52) U.S. Cl.
CPC ... *E04F 11/1817* (2013.01); *E04F 2011/1819* (2013.01); *E04F 2011/1821* (2013.01)

(58) Field of Classification Search
CPC .... F16B 21/086; F16B 7/0446; F16B 7/0473; E04F 11/181; E04F 11/1819; E04F 11/1821; E04H 17/1443; E04H 17/1439; E04H 17/1426
See application file for complete search history.

(56) References Cited

U.S. PATENT DOCUMENTS 3,471,182 A * 10/1969 Schroer ..... E04F 11/1817 403/231
3,598,433 A * 8/1971 Savickas ..... F16B 7/00 297/451.11
3,674,293 A * 7/1972 Parsons ..... F16B 7/0446 182/228.6
3,794,278 A * 2/1974 Frey, Jr. ..... F16L 5/00 248/27.3
4,083,641 A * 4/1978 Sado ..... E04F 11/181 403/260
4,386,870 A * 6/1983 Baroody ..... F16B 7/18 403/234
5,568,909 A * 10/1996 Timko ..... E04H 12/2261 248/519
5,832,548 A * 11/1998 Moser ..... F16B 12/40 5/288
6,012,868 A * 1/2000 Aoki ..... E04F 11/181 403/290
6,065,407 A * 5/2000 Wang ..... A47B 57/545 108/110
6,227,752 B1 * 5/2001 Friedrich ..... F16B 7/0453 403/192

(Continued)

*Primary Examiner* — Daniel J Wiley

(57) ABSTRACT

A baluster joint set has: a first block, a second block and a screwing member. The first block has a base and a plurality of elastic members evenly disposed around the base and having respective gaps therebetween. The first block is further provided with a tubal opening formed by the elastic members, and the base is provided with a through hole at its center. The through hole and the tubal opening are axially aligned, and the base is further provided with a circular slot at an end opposite the elastic members. The elastic member further has a tapered thickness close to the base to provide an adjustment gap. The elastic members each further has a cut angle on an outer edge of the end opposite the base, and the elastic members further have a plurality of slots on a side facing the tubal opening.

8 Claims, 11 Drawing Sheets

(56) References Cited

U.S. PATENT DOCUMENTS

| | | | | |
|---|---|---|---|---|
| 6,889,960 | B1 * | 5/2005 | Jones | E04F 11/1817 256/65.03 |
| 6,971,831 | B2 * | 12/2005 | Fattori | F16B 21/082 411/508 |
| 7,044,448 | B1 * | 5/2006 | Jones | E04F 11/181 256/19 |
| 7,195,222 | B2 * | 3/2007 | Dent | E01F 9/635 248/511 |
| 8,033,530 | B2 * | 10/2011 | Timothy | E04F 11/181 256/22 |
| 8,657,523 | B2 * | 2/2014 | Kuo | E03C 1/0401 211/105.1 |
| 2005/0285091 | A1 * | 12/2005 | Ko | E04H 17/1443 256/24 |
| 2007/0170410 | A1 * | 7/2007 | Devine | E04H 17/1443 256/22 |
| 2018/0073250 | A1 * | 3/2018 | Yu | E04F 11/1848 |

* cited by examiner

BALUSTER JOINT BLOCK

BACKGROUND OF INVENTION

1. Field of Invention

The present invention relates to a baluster joint set, and more particularly to a baluster joint set providing higher offset allowance.

2. Description of Related Art

Currently, as shown in FIG. 11, the conventional baluster joint has a block 50 and a bolt 51, and the block 50 is provided with a through hole 52 at one end and a through aperture at another end. The diameter of the through hole 52 is larger than the diameter of the through aperture 53 and aligned with each other. One end of the bolt 51 is provided with a head portion 511, and the bolt 51 is placed through the through aperture 53 such that the head portion 511 pushes against the through hole 52. Therefore, the block 50 is capable of being secured onto the floor and the rail to assemble baluster with the floor and the rail. However, the following problems exist: 1. the block 50 needs to be aligned with the bolt 511, if the block 50 at the upper end is not aligned with the block 50 at the lower end the baluster cannot be installed. Also the misalignment of the bolt 51 can complicate assembly. 2. The block 50 is only suitable for horizontal surface installation.

Therefore, it is desirable to provide a baluster joint set to mitigate and/or obviate the aforementioned problems.

SUMMARY OF INVENTION

An objective of present invention is to provide a baluster joint set which provides more assembly tolerance.

In order to achieve the above mentioned objective, a baluster joint set comprises: a first block, a second block and a screwing member. The first block has a base and a plurality of elastic members evenly disposed around the base and having respective gaps therebetween. The first block is further provided with a tubal opening formed by the elastic members, and the base is provided with a through hole at its center. The through hole and the tubal opening are axially aligned, and the base is further provided with a circular slot at an end opposite the elastic members. The elastic member further has a tapered thickness close to the base to provide an adjustment gap. The elastic members each further has a cut angle on an outer edge of the end opposite the base, and the elastic members further have a plurality of slots on a side facing the tubal opening. The second block has a connecting portion at one end, and the connecting portion is provided with a circular ring. The second block further has a supporting portion at another end and is further provided with a through aperture through the connecting portion and the supporting portion. The connecting portion of the second block pushes against the base of the first block such that the circular ring engages with the circular slot.

Other objects, advantages, and novel features of invention will become more apparent from the following detailed description when taken in conjunction with the accompanying drawings.

DETAILED DESCRIPTION OF PREFERRED EMBODIMENT

Figure 1:
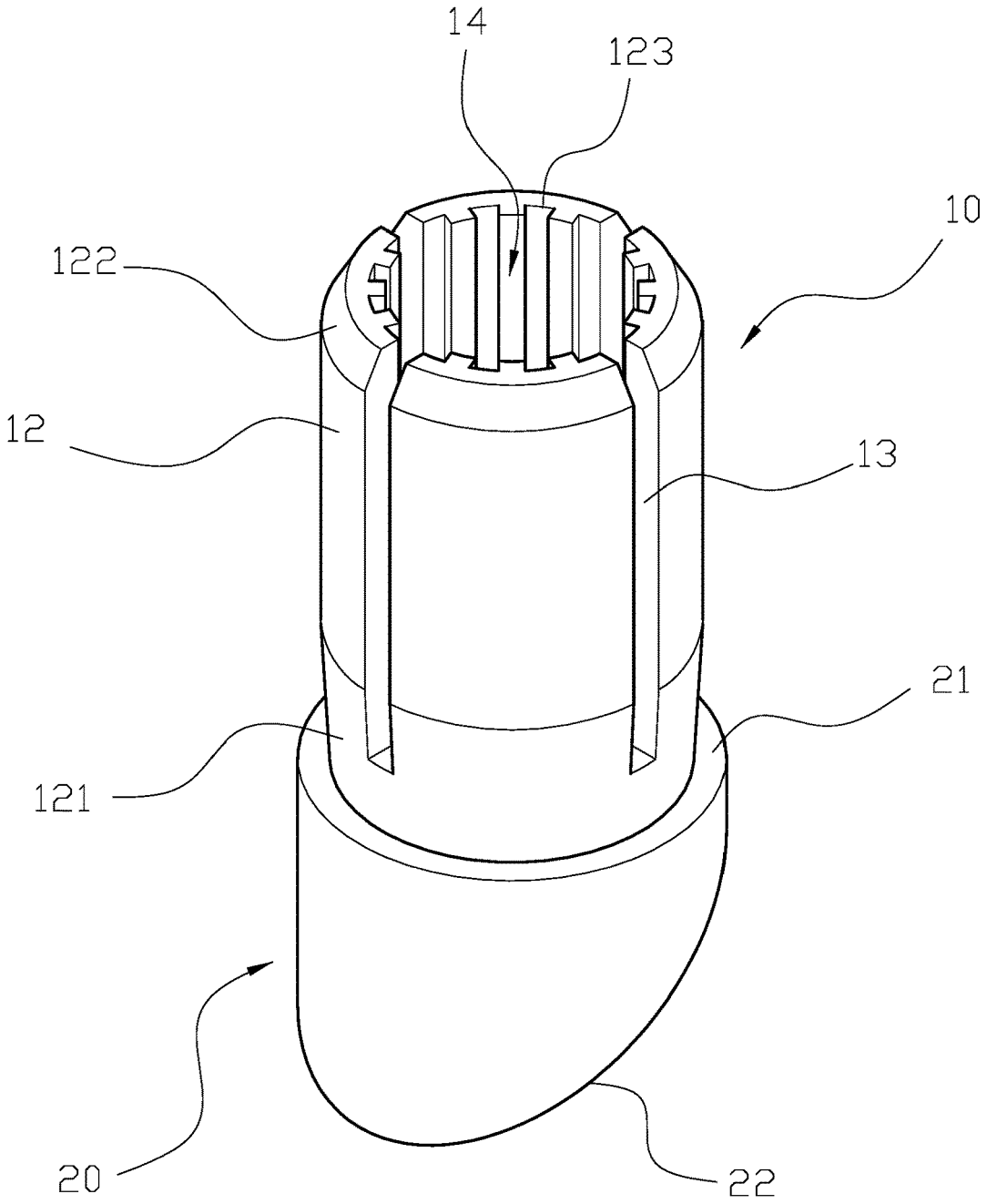
FIG. 1 is a perspective drawing of a preferred embodiment of the present invention.
Figure 2:
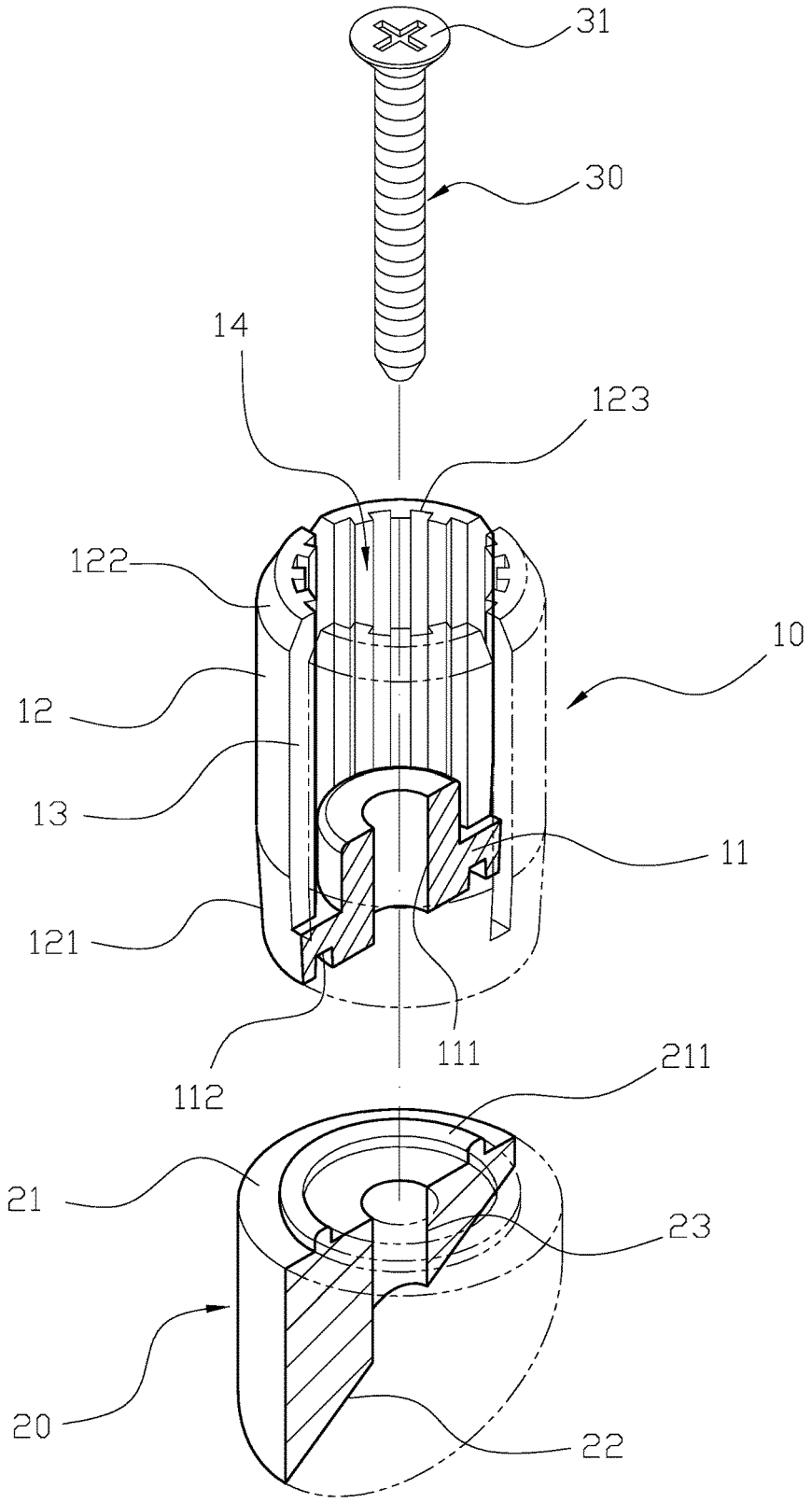
FIG. 2 is an exploded drawing of the preferred embodiment of the present invention.
Figure 3:
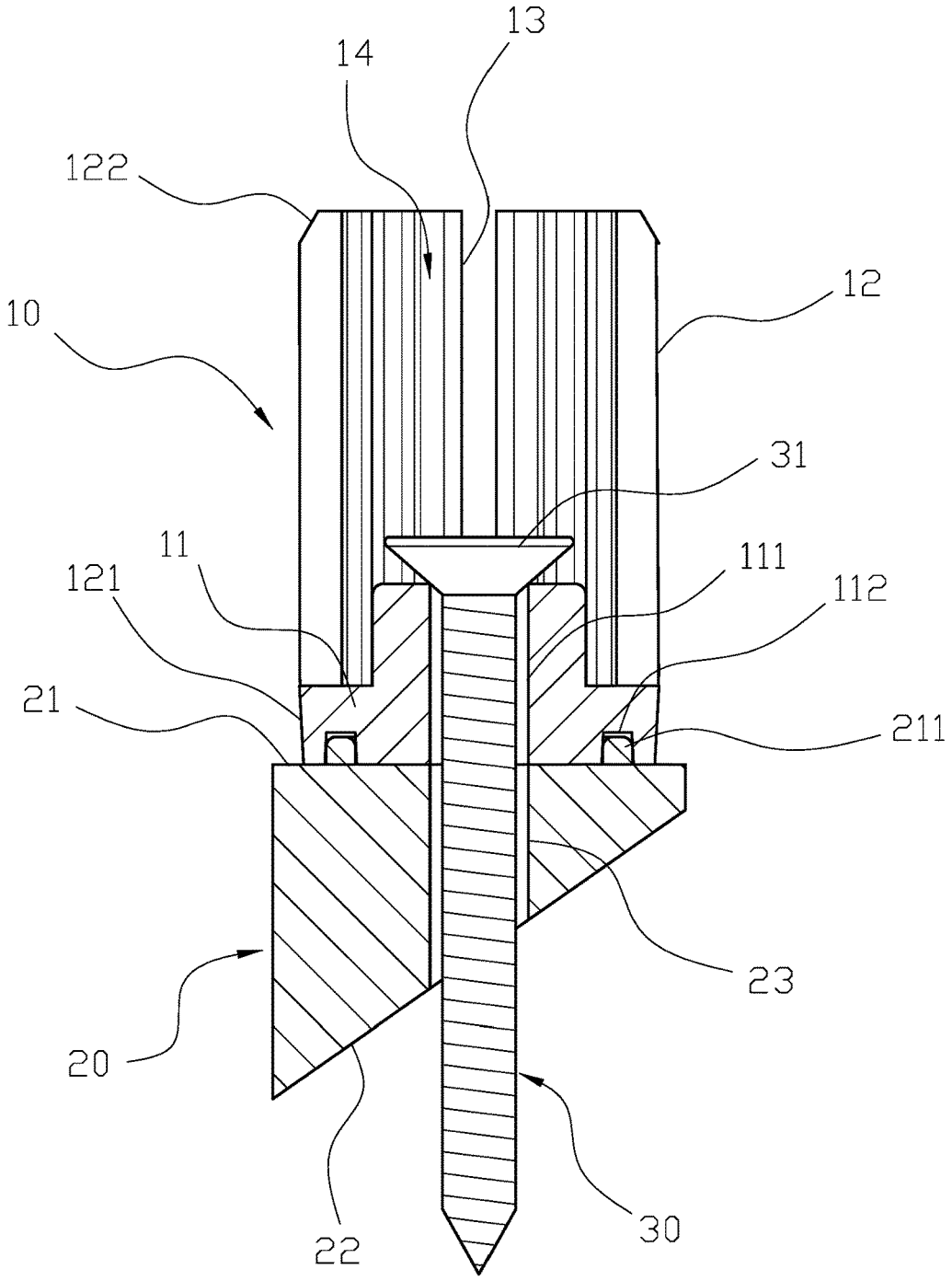
FIG. 3 shows a cross-sectional view of the preferred embodiment of the present invention.
Figure 4:
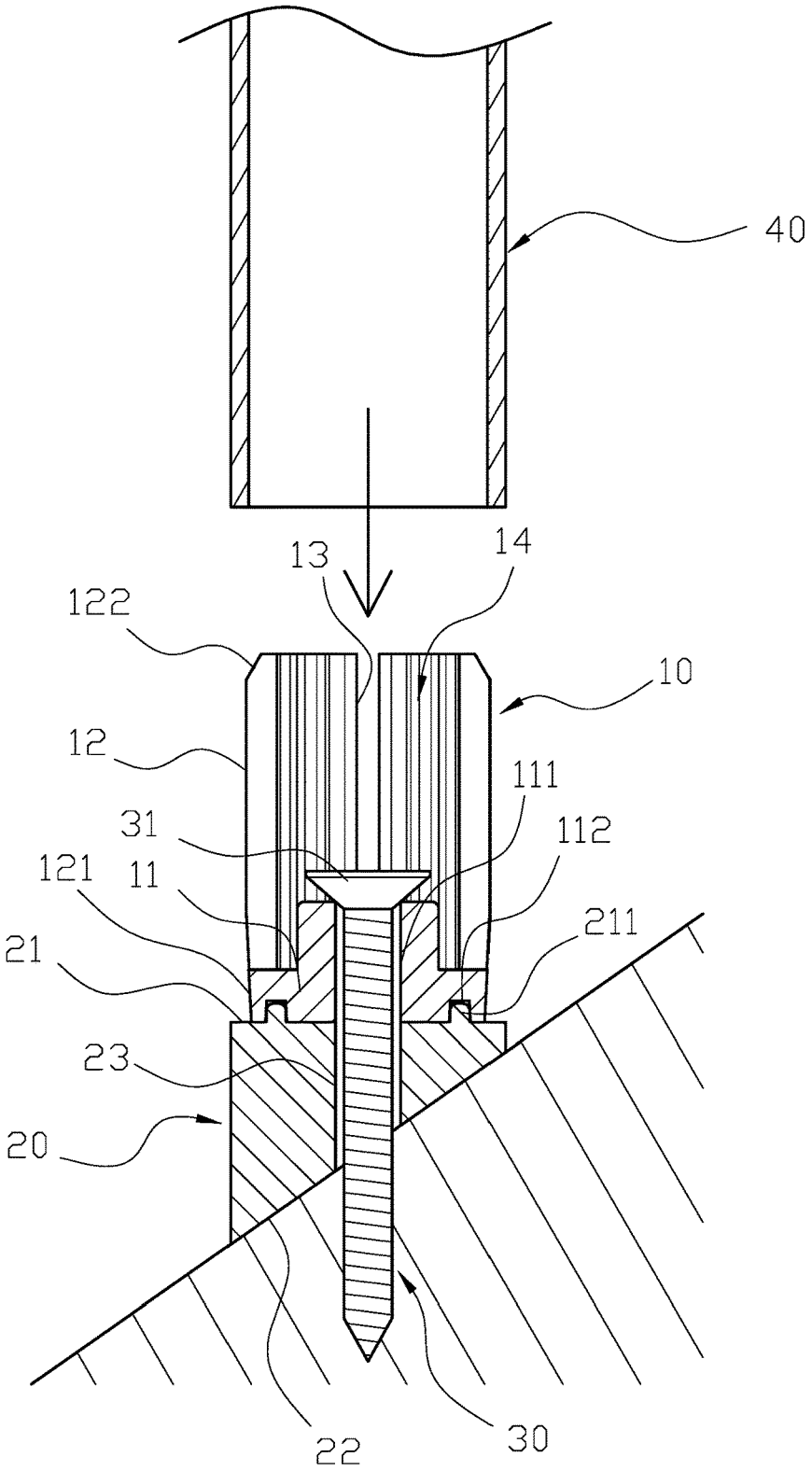
FIG. 4 is a schematic drawing showing an application of the preferred embodiment of the present invention.
Figure 5:
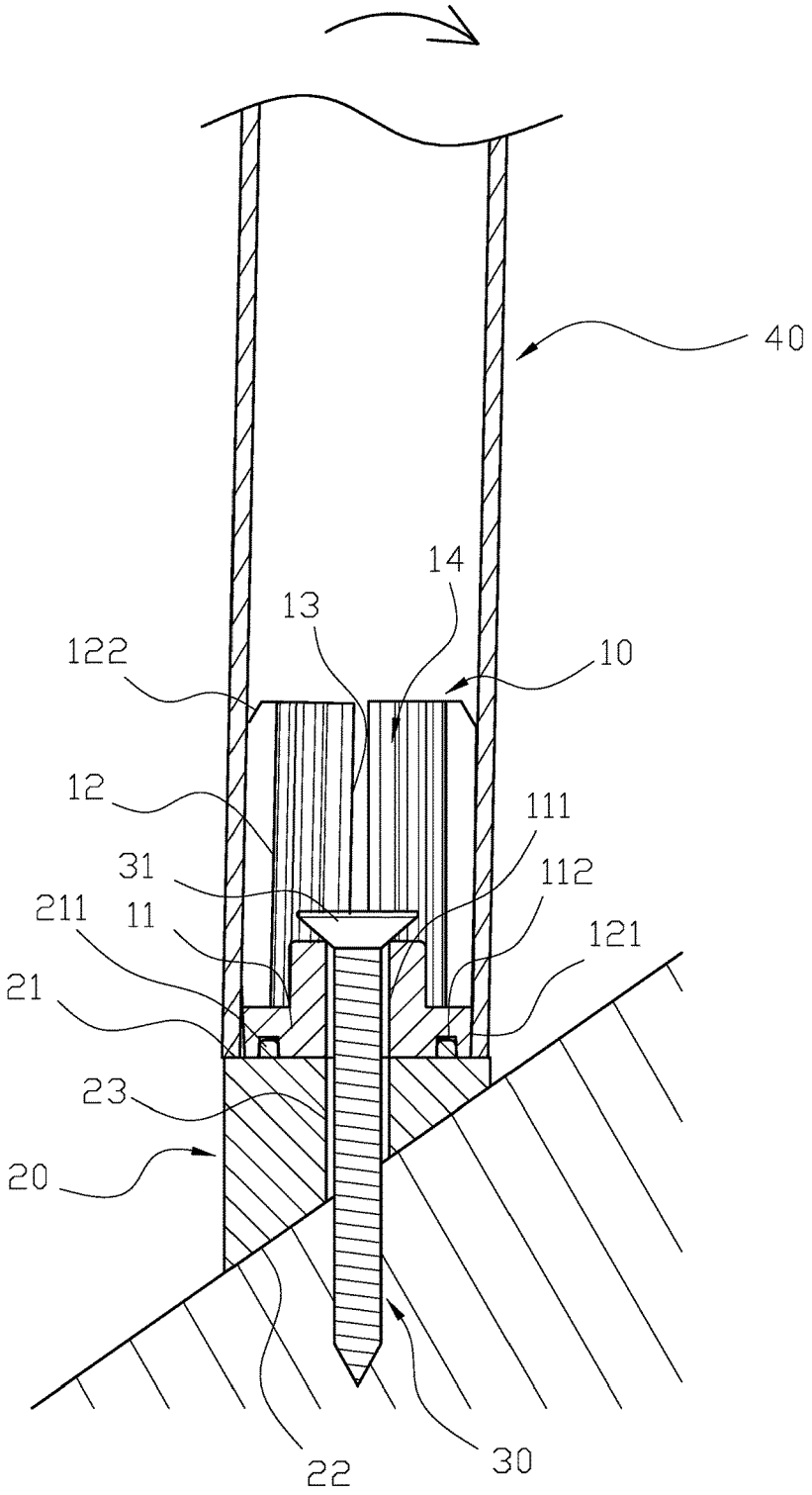
FIG. 5 is another schematic drawing showing the application of the preferred embodiment of the present invention.
Figure 6:
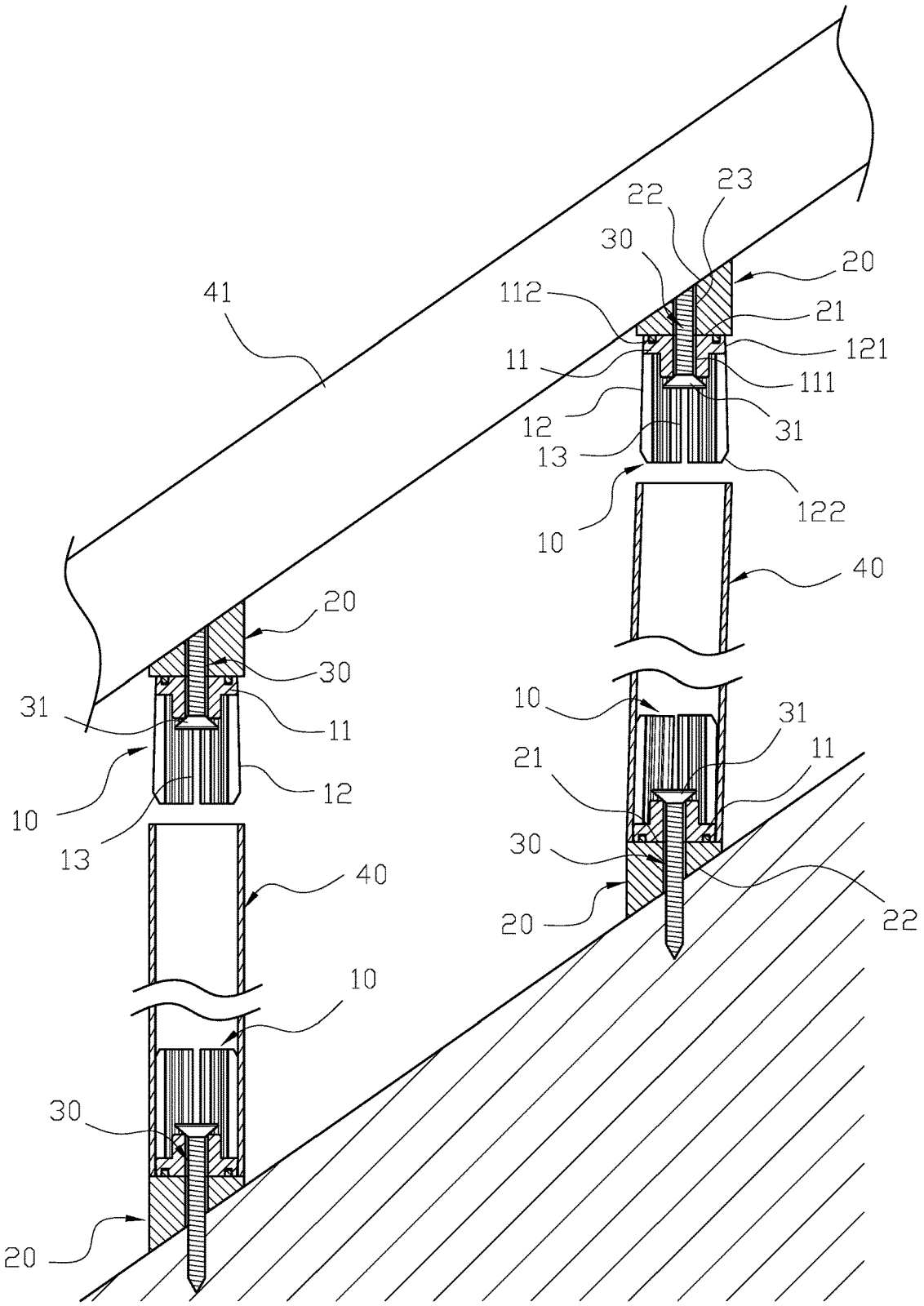
FIG. 6 is another schematic drawing showing the application of the preferred embodiment of the present invention.
Figure 7:
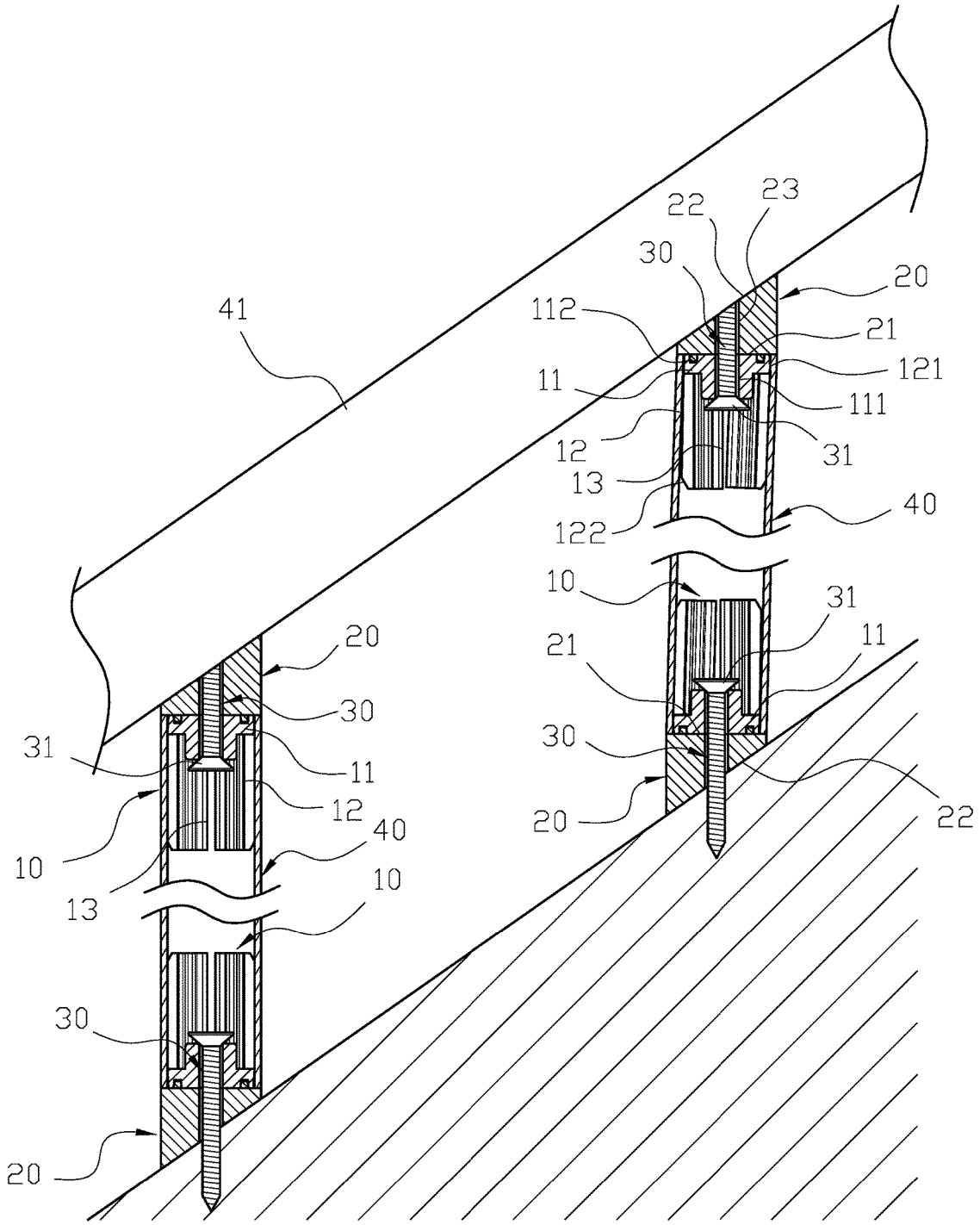
FIG. 7 is another schematic drawing showing the application of the preferred embodiment of the present invention.
Figure 9:
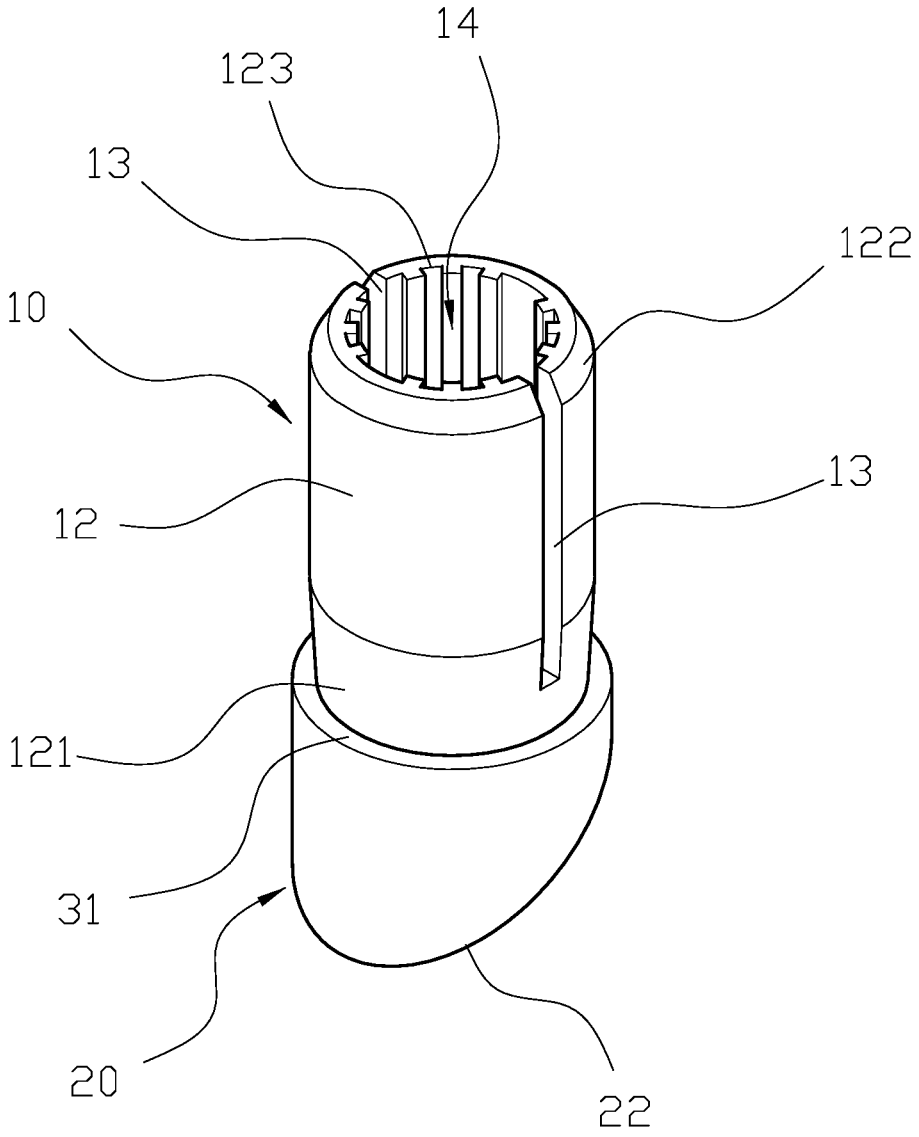
FIG. 9 is a perspective drawing of a preferred embodiment of the present invention.
Figure 10:
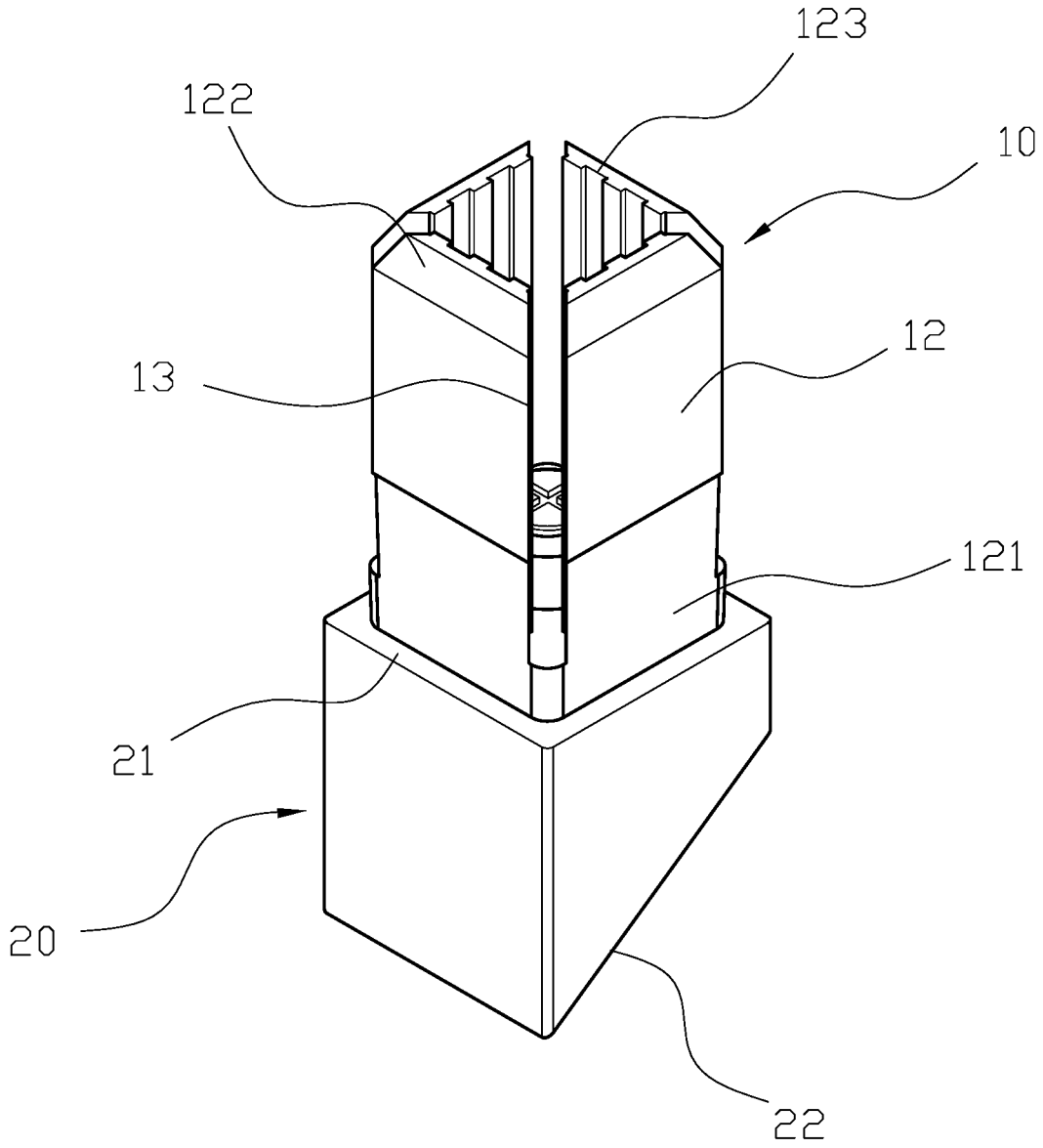
FIG. 10 is a perspective drawing of a preferred embodiment of the present invention.
Figure 11:
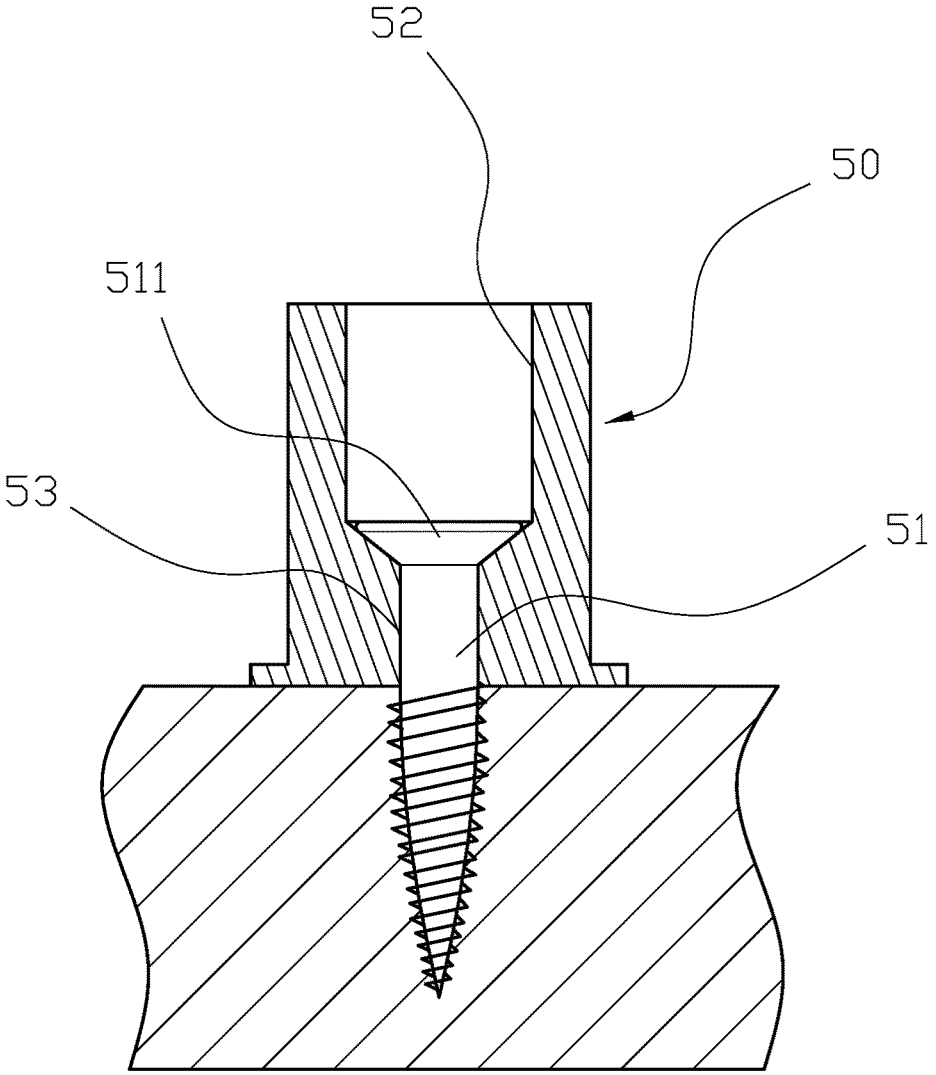
FIG. 11 PRIOR ART
FIG. 11 is a cross-section view of a conventional art.

Please refer to FIG. 1, FIG. 2 and FIG. 3. A baluster joint set comprises: a first block 10, a second block 20 and a screwing member 30. The first block 10 has a base 11 and a plurality of elastic members 12 evenly disposed around the base 11 and having respective gaps 13 therebetween. The first block 10 is further provided with a tubal opening 14 formed by the elastic members 12, and the base 11 is provided with a through hole 111 at its center. The through hole 111 and the tubal opening 14 are axially aligned, and the base 11 is further provided with a circular slot 112 at an end opposite the elastic members 12. The elastic member 12 further has a tapered thickness close to the base 11 to provide an adjustment gap 121. The elastic members 12 each further has a cut angle 122 on an outer edge of the end opposite the base 11, and the elastic members 12 further have a plurality of slots 123 on a side facing the tubal opening 14. The second block 20 has a connecting portion 21 at one end, and the connecting portion 21 is provided with a circular ring 211. The second block 20 further has a supporting portion 22 at another end and is further provided with a through aperture 23 through the connecting portion 21 and the supporting portion 22. The connecting portion 21 of the second block 20 pushes against the base of the first block 10 such that the circular ring 211 engages with the circular slot 112. The first block 10 and the second block 20 are both tubal. Moreover, The first block 10 has four gaps 13 and which are placed in a cross arrangement as shown in FIG. 9; or the first block 10 has two gaps 13 which are evenly placed at two opposite ends of the tubal opening 14 as shown in FIG. 10. Alternatively, the first block 10 and the second block 20 are both rectangular, and the first block 10 has four gaps 13 which are placed at four corners of the first block 10. The connecting portion 21 of the second block 20 is larger than the base 11 of the first block 10. The screwing member 30 has a head portion 31 at one end, another end of the screwing member 30 is placed through the through hole 111 and the through aperture 23, such that the head portion 31 pushes against the base 11 to lock the first block 10 and the second block 20 together. Therefore, the elastic member 12 of the first block 10 is capable of jacketing onto a baluster rod 40 (as shown in FIG. 4.).

Figure 8:
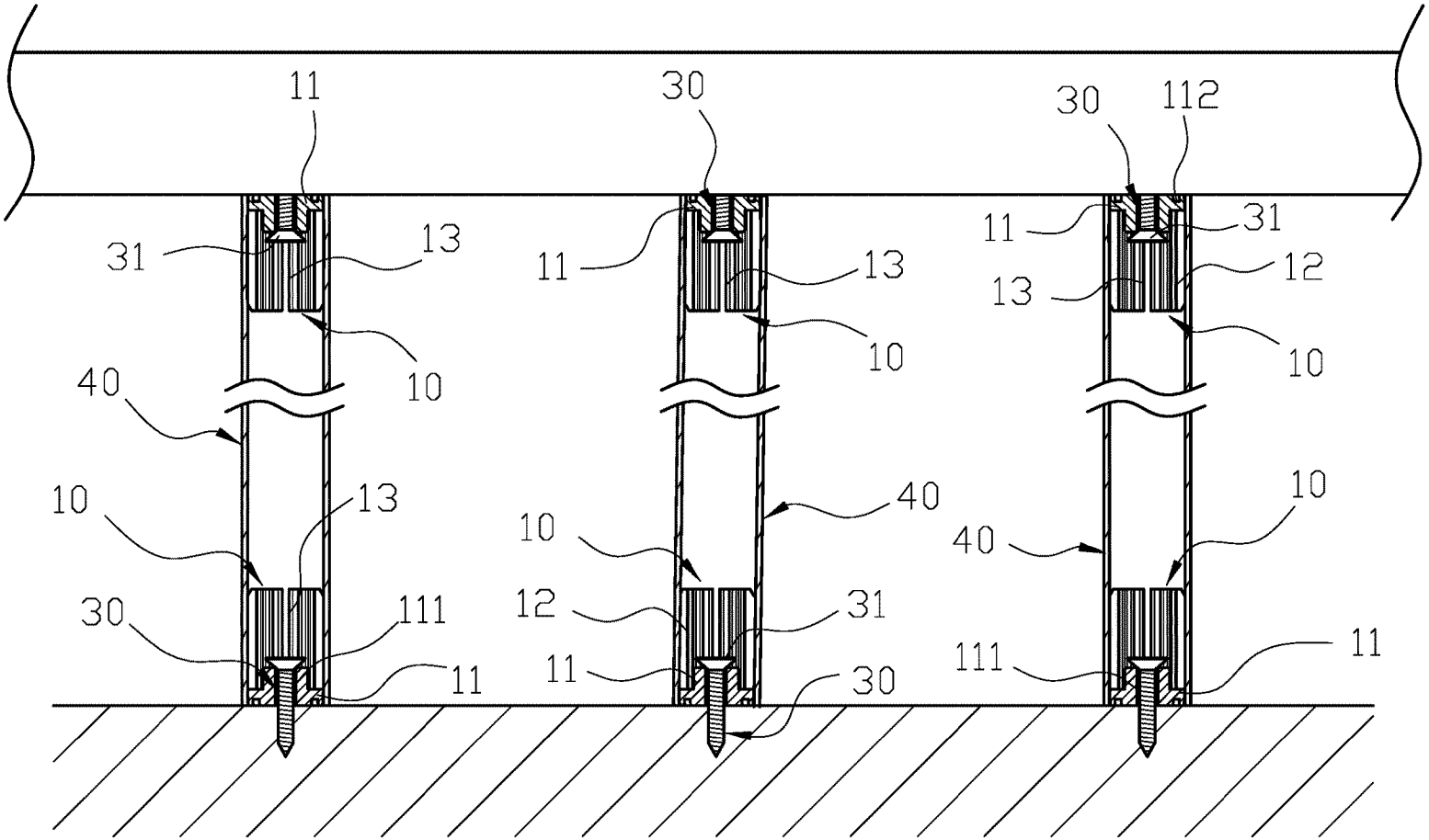
FIG. 8 is a schematic drawing showing another application of the preferred embodiment of the present invention.

For an actual application, please refer to FIG. 2 to FIG. 7. The base 11 of the first block 10 is positioned in the connecting portion 21 of the second block 20, the circular slot 112 of the base 11 engages with the circular ring 211 of the connecting portion 21, such that the through hole 111 of the first block 10 is connected to the through aperture 23 of the second block 20. The screwing member 30 is placed from the first block 10 through the through hole 111 and the through aperture 23. In order to assemble the baluster onto an inclined stairway, the first block 10 and the second block 20 are secured onto the inclined slop via the screwing member 30, the supporting portion 22 of the second block 20 is placed directly onto the inclined surface, such that the elastic member 12 of the first block 10 is up straight. One end of the baluster rod 40 is inserted into the elastic member 12 of the first block 10, and the cut angle 122 of the elastic member 12 helps the insertion of the baluster rod 40. When the baluster rod 40 jackets onto the elastic member 12, the tubal opening 14 and the gap 13 of the elastic member 12 are flexibly deformed to quickly secure the baluster rod 40. Since the connecting portion 21 of the second block 20 is larger than the base 11 of the first block 10, a lower end of the baluster rod 40 pushes against the connecting portion 21 of the second block 20, and the second block 20 is capable of providing support for the baluster rod 40. Similarly, the first block 10 and the second block 20 are installed onto a rail 41, such that the rail 41 can be installed onto another end of the baluster rod 40. Please refer to FIG. 8. For flat surface installation, the second block 20 is omitted, and the screwing member 30 secures the first block 10 onto the surface to keep the elastic member 12 to be vertical.

With the above mentioned structure, following benefit can be obtained: when the first block 10 is secured to the surface or the rail 41, the first block 10 at two ends of the baluster rod 40 can be adjusted accordingly with the offset due to the flexibility provided by the elastic member 12 and the gap 13. Furthermore, with the adjustment gap 121 formed between the elastic member 12 and the base 11, the baluster rod 40 can have a better assembly tolerance.

Although the present invention has been explained in relation to its preferred embodiment, it is to be understood that many other possible modifications and variations can be made without departing from the spirit and scope of invention as hereinafter claimed.

What is claimed is:

1. A baluster joint set comprising:

a first block having a base and a plurality of elastic members evenly disposed around the base and having respective gaps therebetween; the first block further provided with a tubal opening formed by the elastic members, and the base provided with a through hole at its center; the through hole and the tubal opening being axially aligned, and the base further provided with a circular slot at an end opposite the elastic members; the elastic members further having a tapered thickness close to the base to provide an adjustment gap;

a second block having a connecting portion at one end, the connecting portion provided with a circular ring, the second block further having a supporting portion at another end; the second block further provided with a through aperture through the connecting portion and the supporting portion; the connecting portion of the second block pushing against the base of the first block such that the circular ring engages with the circular slot; and a screwing member having a head portion at one end, another end of the screwing member placed through the through hole and the through aperture, the head portion pushing against the base to lock the first block and the second block together.

2. The baluster joint set as claimed in claim 1, wherein the elastic members each further has a cut angle on an outer edge of the end opposite the base.

3. The baluster joint set as claimed in claim 1, wherein the elastic members further have a plurality of slots on a side facing the tubal opening.

4. The baluster joint set as claimed in claim 1, wherein the first block and the second block are both tubal.

5. The baluster joint set as claimed in claim 4, the first block has two gaps which are evenly placed at two opposite ends of the tubal opening.

6. The baluster joint set as claimed in claim 4, wherein the first block has four gaps and which are placed in a cross arrangement.

7. The baluster joint set as claimed in claim 4, wherein the first block and the second block are both rectangular, and the first block has four gaps which are placed at four corners of the first block.

8. The baluster joint set as claimed in claim 1, wherein the connecting portion of the second block is larger than the base of the first block.

* * * * *